US007797092B2

(12) United States Patent
Schifferer et al.

(10) Patent No.: US 7,797,092 B2
(45) Date of Patent: Sep. 14, 2010

(54) METHOD AND SYSTEM FOR CONTROLLING MACHINE POWER

(75) Inventors: Andrew N. Schifferer, Batavia, IL (US); John D. Baus, Yorkville, IL (US)

(73) Assignee: Caterpillar Inc, Peoria, IL (US)

( * ) Notice: Subject to any disclaimer, the term of this patent is extended or adjusted under 35 U.S.C. 154(b) by 882 days.

(21) Appl. No.: 11/593,044

(22) Filed: Nov. 6, 2006

(65) Prior Publication Data

US 2008/0104954 A1 May 8, 2008

(51) Int. Cl.
*G06F 19/00* (2006.01)

(52) U.S. Cl. ..... 701/50

(58) Field of Classification Search ..... 701/50; 290/40 R; 417/1; 172/2–3; 60/431
See application file for complete search history.

(56) References Cited

U.S. PATENT DOCUMENTS

| | | | | |
|---|---|---|---|---|
| 3,792,791 | A | 2/1974 | Fleming et al. | |
| 4,523,892 | A | 6/1985 | Mitchell et al. | |
| 4,536,126 | A * | 8/1985 | Reuther | 290/40 R |
| 4,637,781 | A | 1/1987 | Akiyama et al. | |
| 4,702,083 | A | 10/1987 | Nakamura et al. | |
| 5,468,126 | A * | 11/1995 | Lukich | 417/53 |
| 5,638,677 | A | 6/1997 | Hosono et al. | |
| 6,183,210 | B1 | 2/2001 | Nakamura | |
| 6,321,866 | B1 | 11/2001 | Prohaska | |
| 6,901,324 | B2 | 5/2005 | Rose et al. | |
| 6,920,387 | B2 | 7/2005 | Landes et al. | |
| 7,044,257 | B2 | 5/2006 | Kempf et al. | |
| 2004/0098984 | A1 | 5/2004 | Duell et al. | |
| 2005/0071064 | A1 | 3/2005 | Nakamura et al. | |
| 2005/0241304 | A1 | 11/2005 | Bankestad et al. | |
| 2005/0246040 | A1 | 11/2005 | Horkavi et al. | |
| 2006/0018765 | A1 | 1/2006 | Fransson et al. | |

FOREIGN PATENT DOCUMENTS

| | | |
|---|---|---|
| EP | 0 945 619 | 9/1999 |
| EP | 1 398 512 | 3/2004 |
| WO | WO 2006/016653 | 9/1999 |
| WO | WO 2006/011835 A1 | 2/2006 |

* cited by examiner

*Primary Examiner*—Yonel Beaulieu
(74) *Attorney, Agent, or Firm*—Finnegan, Henderson, Farabow, Garrett & Dunner LLC

(57) ABSTRACT

In one aspect, the present disclosure is directed to a method for controlling power distribution. The method includes monitoring at least one parameter associated with a power source including a fuel limit proximity of the power source, generating a control signal based on the at least one parameter, and reducing a load associated with the power source based on a characteristic of the control signal.

17 Claims, 3 Drawing Sheets

METHOD AND SYSTEM FOR CONTROLLING MACHINE POWER

TECHNICAL FIELD

This disclosure relates generally to controlling power associated with a machine and, more particularly, to a system and method for utilizing a fuel map associated with a power source to control power distribution associated with the machine.

BACKGROUND

Machines, including vocational vehicles, off-highway haul trucks, motor graders, wheel loaders, and other types of large machines associated with construction, mining, and other industries often include implements (e.g., bucket loaders) and steering components powered via hydraulic pressure. To provide hydraulic pressure for operation of such implements and components, one or more hydraulic pumps have typically been included on such machines.

Hydraulic pumps associated with a machine may be driven by a power source associated with the machine and the resulting pressurized fluid may operate the desired components of the machine (e.g., steering and implements). This operation of hydraulic pumps may exert a torque on the power source based on pump discharge pressure (e.g., a function of overall load on the pump) and a flow rate associated with the hydraulic pump, among other things. This torque may, therefore, draw a countering torque from the power source such that the power source may continue to operate with less available torque for countering other loads (e.g., accelerating the machine). The torque available from the power source may depend on numerous factors such as, for example, power source size and power source speed, among other things.

Because power sources are typically torque limited, it may be possible to apply a torque load greater than what an associated power source can provide. Therefore, a simultaneous loading from hydraulic pumps and machine acceleration may prevent an associated power source from increasing its speed, which may cause an apparent lack of response and/or power from the machine, among other problems. Where the torque associated with the hydraulic pump approaches or exceeds the operational limitations of the power source, the power source may lug or even stall.

Additionally, government standards associated with power source emissions have increased the burden on manufacturers to reduce the amount of particulate matter and other emissions that may be exhausted from power sources associated with their machines. Because steering and implement loading may affect such emissions (e.g., via torque loading), it may be desired to exert additional control over the torque load placed on a power source.

Variable displacement hydraulic pumps may allow for some control of the torque associated with a hydraulic pump by introducing a flow control mechanism (e.g., a swash plate) into the hydraulic pump. Using load sense pressure feedback signals, flow from the pump may be modified based on numerous factors including steering and implement load.

One system for controlling a variable displacement hydraulic pump is disclosed in U.S. Patent Application 2005/0071064 to Nakamura et al. ("the '064 publication"). The '064 publication includes a signal processing system designed to receive environment variables associated with operation of a power source and a variable displacement hydraulic pump. The signal processing system may then modify a pilot pressure fed back to the variable displacement pump based on the environment variables, to effect a reduction of flow and, therefore, torque associated with the variable displacement hydraulic pump.

While the '064 publication may control torque reduction associated with a variable displacement hydraulic pump, the '064 publication is directed to a machine with a targeted optimal speed of an associated power source (e.g., 2500 revolutions per minute (RPM)). Therefore, the system and related environment variables of the '064 publication may not be suitable for use in application where a power source speed is transient. Further, the '064 publication considers latent parameters associated with a driving power source (e.g., engine speed), thereby utilizing reactive measures to control power distribution, which may ultimately affect control precision. Moreover, the '064 publication fails to consider resulting emissions (e.g., smoke) when determining how the torque should be modified. Because emissions standards have become more stringent, additional limitations may be considered during operation of a hydraulic pump at a particular flow rate and pressure, such that emissions meet government requirements.

The present disclosure is directed at overcoming one or more of the problems or disadvantages in the prior art control systems.

SUMMARY OF THE DISCLOSURE

In one aspect, the present disclosure is directed to a method for controlling power distribution. The method may include monitoring at least one parameter associated with a power source including a fuel limit proximity of the power source, generating a control signal based on the at least one parameter, and reducing a load associated with the power source based on a characteristic of the control signal.

In another aspect, the present disclosure is directed to a system for controlling power distribution. The system may include a power source operatively connected to a variable displacement hydraulic pump and configured to drive the variable displacement hydraulic pump and a controller configured to monitor at least one parameter including a fuel limit proximity of the power source and generate a control signal based on the at least one parameter. The system may further include a flow control assembly configured to control a flow associated with the variable displacement hydraulic pump based on a characteristic of the control signal.

In yet another aspect, the present disclosure is directed to a machine. The machine may include a frame, a traction device, a variable displacement hydraulic pump, and a power source operatively connected to the frame, the traction device, and the variable displacement hydraulic pump. The machine may further include a controller configured to monitor at least one parameter including a fuel limit proximity of the power source, and also configured to generate a control signal based on the at least one parameter. The machine may further include a flow control assembly configured to control a flow associated with the variable displacement hydraulic pump based a characteristic of the control signal.

In yet another aspect, the present disclosure is directed to a method for controlling a variable displacement pump associated with a power source. The method may include determining a fuel flow to a combustion chamber associated with the power source and controlling a displacement of the variable displacement pump based in part on the determination.

DETAILED DESCRIPTION

The following discussion may primarily discuss controlling power distribution associated with a power source and an implement powered by a variable displacement hydraulic pump. However, it is important to note that the systems and methods discussed herein for using a fuel map for controlling power distribution and balancing may be equally applicable to numerous other machine control configurations. For example, disclosed systems and methods for utilizing a fuel map for controlling power distribution may also be applied to balance power between a machine steering system and power train, among other things. Further, by utilizing the disclosed system and methods, predictive power distribution, as opposed to reactive power distribution, may be accomplished, which may lead to enhanced control precision, among other things.

Figure 1:
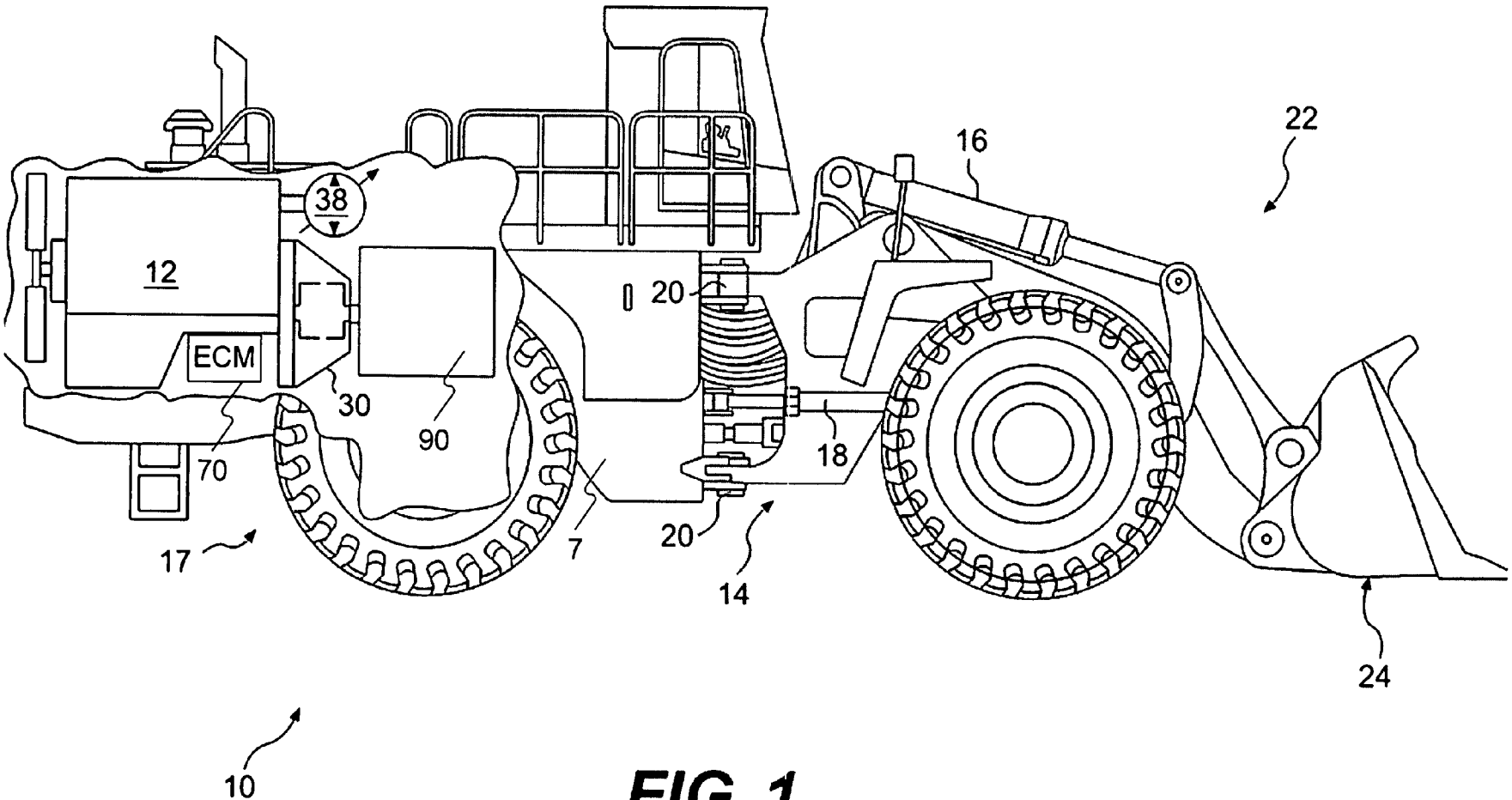
FIG. 1 illustrates an exemplary embodiment of a machine.

FIG. 1 illustrates an exemplary embodiment of a machine 10. Machine 10 may be a mobile machine that performs some type of operation associated with an industry such as mining, construction, farming, or any other industry known in the art. For example, machine 10 may be an earth moving machine such as a wheel loader, a dump truck, a backhoe, a motor grader, or any other suitable machine. Machine 10 may include a power source 12, a frame 7, an electronic control module (ECM) 70, a steering mechanism 14, and a transmission 30 connected to at least one driven traction device 17. Machine 10 may further include one or more implement systems 22.

Power source 12 may be an engine such as, for example, a diesel engine, a gasoline engine, a gaseous fuel powered engine such as a natural gas engine, or any other engine apparent to one skilled in the art. Power source 12 may also embody another source of power such as a fuel cell, a power storage device, or any other source of power known in the art.

Transmission 30 may be connected to power source 12 and may include one or more hydraulic pumps and/or hydraulic motors 90. The one or more hydraulic pumps and/or hydraulic motors 90 may be variable displacement, variable delivery, fixed displacement, or any other configuration known in the art. Transmission 30 may include transmissions such as hydraulically operated planetary gear transmissions, constantly variable transmissions, infinitely variable transmissions, and any other type of transmission known in the art. Transmission 30 may also include an output shaft operatively connecting power source 12 to traction device 17. Machine 10 may or may not include a reduction gear arrangement such as, for example, a planetary arrangement disposed between power source 12 and traction device 17.

Implement system 22 may include an implement 24 for performing various tasks including, for example, loading, compacting, lifting, brushing, and other desired tasks. Implement 24 may include numerous devices such as, for example, buckets, compactors, forked lifting devices, brushes, or other suitable devices as desired for accomplishing particular tasks. For example, machine 10 may be tasked to moving excavated earth from one point to another at a mine or similar site. Such an arrangement may be conducive to utilizing a bucket loader implement similar to that shown as implement 24.

Implement system 22 may further include one or more implement hydraulic cylinders 16 for imparting motion to various portions of implement system 22 (e.g., lifting and/or tilting implement 24). Implement hydraulic cylinders 16 may work in cooperation with various pivot points associated with implement system 22 to effect a desired motion. Motion of implement system 22 may be imparted via extension and retraction of pistons associated with the one or more implement hydraulic cylinders 16.

Implement system 22 may also include sensing mechanisms designed to sense a load associated with implement system 22. Such sensors may include electrical and/or mechanical sensors or any combination thereof. For example, implement system 22 may include one or more directional spool valves (not shown), which may include such sensing mechanisms. The sensing mechanisms associated with the one or more directional spool valves may provide information indicative of a current load on implement system 22. Alternatively, implement hydraulic cylinders 16 may include load sense lines (not shown) configured to transmit a hydraulic pressure associated with an implement load within implement 24. Load sense line (not shown) may be a hydraulic line fluidly connected to one or both chambers of hydraulic cylinder 16 and configured to permit some hydraulic fluid flow. Load sense line (not shown) may then be fluidly connected to one or more devices configured to convert a pressure signal into an appropriate electrical and/or mechanical signal. Other devices for providing a load sense signal may be utilized without departing from the scope of the present disclosure.

Steering mechanism 14 may include one or more steering hydraulic cylinders 18 located on each side of machine 10 (only one side shown) that function in cooperation with a centrally-located articulated joint 20. To affect steering, the hydraulic cylinder 18 located on one side of machine 10 may extend while the hydraulic cylinder 18 located on the opposite side of machine 10 simultaneously retracts, thereby causing a forward end of machine 10 to pivot about articulated joint 20 relative to a back end of machine 10. It is contemplated that steering mechanism 14 may alternatively include a greater or lesser number of hydraulic cylinders 18, a different configuration of hydraulic cylinders 18 such as a direct connection to one or more steerable traction devices of machine 10, and/or that hydraulic cylinders 18 may be omitted and the steering of machine 10 affected by a different type of hydraulic actuator such as, for example, a hydraulic motor in a rack and pinion configuration.

Electronic control module (ECM) 70 may be communicatively connected to various systems associated with power source 12 and machine 10, and may be configured to provide data to and receive data from such systems. ECM 70 may be any device known in the art suitable for receiving and providing data related to operation of power source 12. For example, ECM 70 may be a computer or other similar device.

Figure 2:
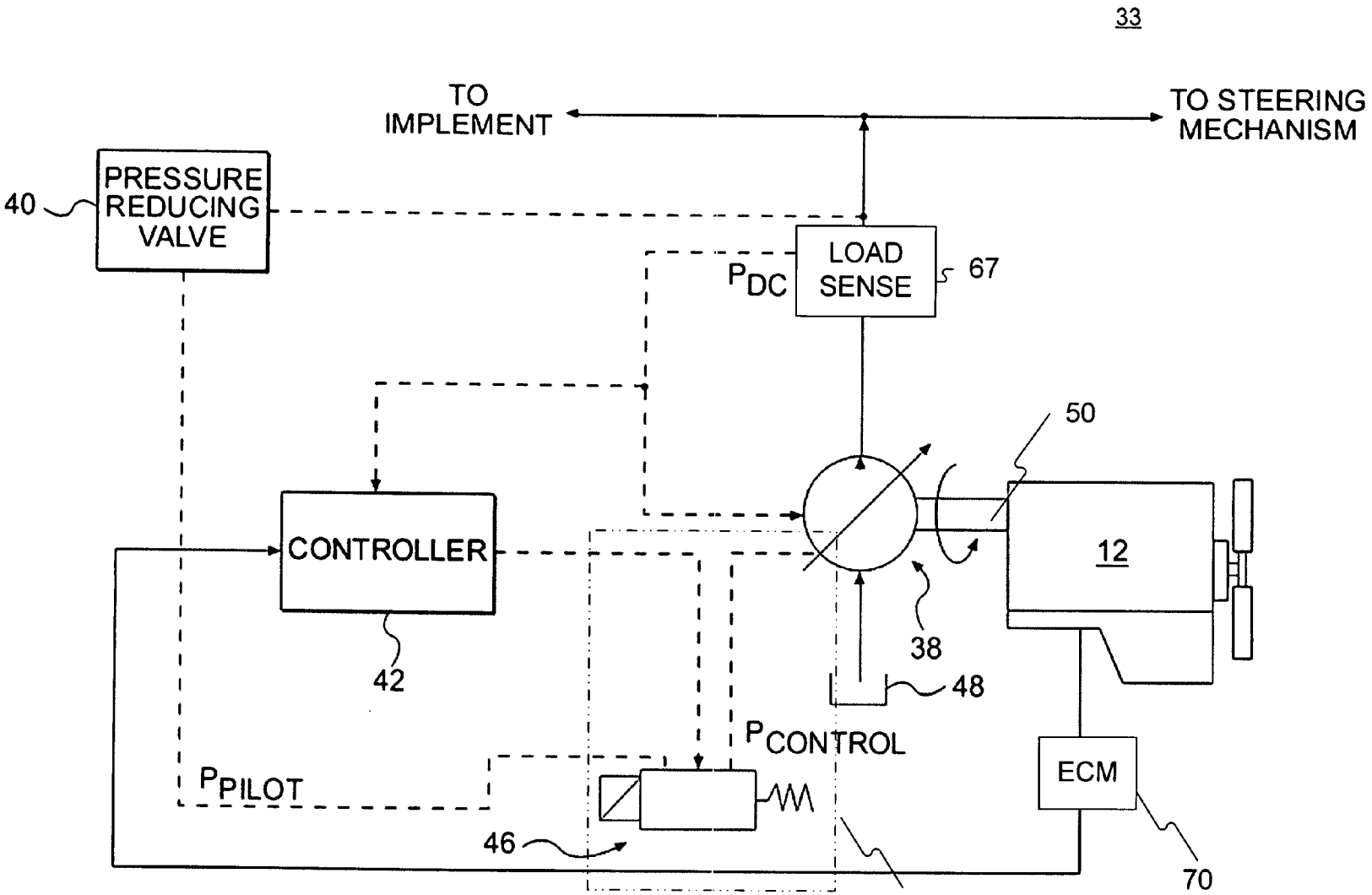
FIG. 2 illustrates a high level hydraulic schematic consistent with an embodiment of the present disclosure.

FIG. 2 is a high level schematic of an exemplary variable torque hydraulic circuit that may be utilized with machine 10. Machine 10 may include a hydraulic circuit 33 fluidly connected to an implement circuit configured to actuate implement system 22 and a steering circuit configured to actuate steering mechanism 14. Although FIG. 2 illustrates hydraulic circuit 33 being dedicated to supplying pressurized fluid to the implement circuit and steering circuit, it is contemplated that hydraulic circuit 33 may alternately supply pressurized fluid to more or fewer machine hydraulic circuits as desired. Further, implement circuit and steering circuit may operate from a shared hydraulic circuit, or additional pumps and associated circuits may be provided such that each hydraulic circuit may receive pressurized fluid via its own designated hydraulic pump.

Hydraulic circuit 33 may include a variable displacement hydraulic pump 38, one or more valves (e.g., pressure reducing valve 40), a flow-control assembly 52, load sense pressure sensor 67, and a controller 42, among other things.

Variable displacement hydraulic pump 38 may be configured to draw a fluid from a reservoir 48 and produce a flow of fluid at a particular discharge pressure. In so doing, variable displacement hydraulic pump 38 may exert a torque on power source 12. This torque may be calculated based on a discharge pressure of the pump (i.e., $P_{dc}$) and an associated flow rate of pressurized hydraulic fluid from the pump. Alternatively, torque may be calculated based on a condition of flow-control assembly 52 (e.g., swash plate angle), among other things. Variable displacement hydraulic pump 38 may include a pump-flow control component such as a swash plate configured to vary the stroke of one or more pistons associated with the pump. By varying the stroke of the one or more pistons, maximum pump flow may be increased or decreased as desired, thereby increasing or decreasing the resulting maximum pump torque. Maximum pump torque, as used herein, will be understood to mean the maximum torque that may be applied by variable displacement hydraulic pump 38 to power source 12 at any particular discharge pressure with pump 38 operating at maximum flow (i.e., full command).

Variable displacement hydraulic pump 38 may be operatively connected to power source 12 by, for example, a countershaft 50, a belt (not shown), an electrical circuit (not shown), or in any other suitable manner. Additionally, pressurized fluid from variable displacement hydraulic pump 38 may be supplied to numerous signal pressure circuits included with machine 10. Pressurized fluid may be supplied to various valves (e.g., pressure reducing valve 40, one or more directional spool valves (not shown), etc.) associated with machine 10 and/or directly from hydraulic pump 38. For example, a load sense pressure ($P_{dc}$) associated with variable displacement hydraulic pump 38 may be provided by a directional spool valve (not shown) receiving a flow of fluid from hydraulic pump 38. This load sense signal may then be provided to controller 42, feedback spools associated with variable displacement hydraulic pump 38, and/or other suitable devices.

Variable displacement hydraulic pump 38 may be configured to receive pressure signals indicating adjustments to operational parameters (e.g., flow rate) of variable displacement hydraulic pump 38. Such pressure signals may include, for example, a discharge pressure signal ($P_{dc}$) and a flow adjustment signal ($P_{control}$). For example, $P_{dc}$ may be indicative of the load associated with variable displacement hydraulic pump 38, while $P_{control}$ may be indicative of a flow rate modification to variable displacement hydraulic pump 38 utilized for modifying a torque associated with hydraulic pump 38. Feeding back such pressure signals to variable displacement hydraulic pump 38 may cause associated increases or decreases in fluid flow (e.g., by causing angular variation in a swash plate associated with pump 38).

One or more valves may be fluidly connected within hydraulic circuit 33. For example, a pressure reducing valve 40 may be configured to receive a portion of a flow of pressurized hydraulic fluid from hydraulic pump 38, and may use such a flow to maintain a particular pressure (e.g., $P_{pilot}$) in a portion of hydraulic circuit 33. Further, one or more valves may be configured to provide pressure signals (e.g., $P_{dc}$) to other portions of hydraulic circuit 33 and/or other hydraulic circuits. Such valves may include shuttle valves, directional valves, pressure reducing valves, pressure relief valves, and/or other suitable devices. While $P_{pilot}$ is shown as being supplied from variable displacement hydraulic pump 38 to pressure reducing valve 40, $P_{pilot}$ may be supplied from any other suitable source of pressurized fluid associated with machine 10. For example, $P_{pilot}$ may be supplied by load sense pressure sensor 67, a hydraulic fan circuit, a powered lift circuit, a pilot pump, or any other suitable source.

Load sense pressure sensor 67 may be configured to receive a portion of pressurized fluid from variable displacement hydraulic pump 38 (e.g., duplicating pump discharge pressure) and to measure a load indicative pressure (e.g., $P_{dc}$). Load sense pressure sensor 67 may be associated with one or more fluid handling devices, including, for example directional spool valves. Load sense pressure sensor 67 may include pressure transducers, valves, and other suitable devices. For example, load sense pressure sensor 67 may be configured to receive a portion of pressurized fluid from variable displacement hydraulic pump 38 and may, in turn, measure $P_{dc}$ while providing portions of the pressurized fluid to flow-control assembly 52 and controller 42.

Flow-control assembly 52 may be configured to control a flow of hydraulic fluid associated with variable displacement hydraulic pump 38. Flow control assembly 52 may include a signal modifying component 46 and a pump-flow modifying component (not shown), among other things. Signal modifying component 46 may include a solenoid valve, or other suitable device, configured to receive a first pressure signal (e.g., $P_{pilot}$) and a control signal, and modify the first pressure signal to produce a flow adjustment signal (e.g., $P_{control}$) based on a characteristic of the control signal. For example, signal modifying component 46 may increase or decrease $P_{pilot}$ based on an electrical current associated with a control signal received from controller 42. This may be accomplished by opening and closing of signal modifying component 46 in relation to the electrical current. In one embodiment, an inverse relationship may exist between the characteristic and a torque associated with variable displacement hydraulic pump 38. In other words, an increase in the current associated with the control signal may cause signal modifying component 46 to increase $P_{control}$, thereby limiting maximum pump flow and decreasing maximum pump torque. Conversely, where the characteristic of the control signal is decreased (e.g., reduction in current), signal modifying component 46 may cause a decrease in $P_{control}$, thereby reducing the limitation on pump flow and increasing maximum pump torque.

Pump-flow modifying component (not shown) may be configured to adjust a maximum flow of pressurized hydraulic fluid associated with variable displacement hydraulic pump 38 based on a flow adjustment signal $P_{control}$. In one embodiment, pump-flow modifying component may include an adjustable swash plate internal to variable displacement hydraulic pump 38. In such an embodiment a variable angle associated with the swash plate may affect maximum pump flow by varying a stroke length of reciprocating pistons producing the pressurized fluid flow. One of ordinary skill in the art will recognize that other pump-flow modifying components (or methods) may be used. For example, it may be desired to control pump flow via a pump speed modulator or other suitable device.

Controller 42 may be a mechanical or an electrical based controller configured to monitor, sample, and/or receive operating parameters associated with machine 10 and variable displacement hydraulic pump 38. For example, parameters may include, discharge pressure ($P_{dc}$) of variable displacement hydraulic pump 38, a speed associated with the power source (e.g., revolutions per minute), a fuel delivery rate to the power source, a fuel limit proximity of the power source, and an atmospheric pressure. Fuel limit proximity, as used herein, shall mean the difference between a predetermined limiting fuel volume associated with a power source and a currently delivered fuel volume to the power source. For example, a smoke limit fuel volume of power source 12 may be determined based on experimental and/or test data associated with power source 12. Such data may reveal that fuel delivered in excess of a particular volume (e.g., 85 $mm^3$ per injector stroke) to power source 12 operating at a particular speed (e.g., 850 RPM) may cause the emission of smoke, which may violate emission regulations and/or waste fuel. Therefore, the smoke limit fuel volume of power source 12 at 850 RPM may be 85 $mm^3$ per injector stroke. An associated smoke fuel limit proximity for power source 12 operating at 850 RPM may be calculated based on the smoke limit fuel volume of 85 $mm^3$ per injector stroke minus the actual supplied volume of fuel to power source 12 (e.g., 70 $mm^3$), yielding a current fuel limit proximity of 15 $mm^3$ per injector stroke. Fuel limit proximity may also be determined based on other limits, including, for example, torque limit fuel volume.

Controller 42 may be communicatively connected to various systems associated with machine 10 including, for example, flow-control assembly 52, power source ECM 70, and load sense pressure sensor 67, among other things. Controller 42 may further be configured to provide a control signal including various characteristics based on the monitored parameters to flow-control assembly 52. Characteristics of the control signal may include, for example, voltage, current, frequency, and/or other suitable characteristics. In one embodiment, controller 42 may be configured to vary a current and/or a voltage characteristic of the control signal based on the monitored parameters. In such an embodiment, controller 42 may determine that a maximum torque load placed on power source 12 at a particular operating condition is 175 Nm. Based on this information, controller 42 may determine that a control signal may include a current at 2 amps. Controller 42 may, therefore, send a 2 amp control signal to flow control assembly 52 causing a resulting reduction in maximum torque of pump 38.

Controller 42 may store data and algorithms related to fuel limits, torque limits, power source speeds, atmospheric pressures, power source torque output, fuel limit proximities and associated control signal characteristics, and combinations thereof, in memory or other suitable storage location. Such data may enable a determination of acceptable torque loads that may be applied based on the various fuel limits associated with power source 12. Data may be experimentally collected and based on power source size, speed (i.e., rotations per minute (RPM)), and/or torque load, among other things. Such data may be stored in a lookup table within controller 42 for reference and/or portions of data may be calculated using algorithms stored within controller 42 and based on similar parameters. For example, controller 42 may contain data indicating that the smoke limit fuel volume of a power source operating at 850 RPM is 85 $mm^3$. Controller 42 may also contain data indicating that at a fuel volume of 85 $mm^3$ and a power source speed of 850 RPM, the maximum torque that may be applied to power source 12 to provide desired performance (e.g., no lugging and/or stalling) may be 175 Nm. Controller 42 may, therefore, also contain algorithms for determining when a control signal should be sent to flow-control assembly 52 causing a reduction in maximum pump torque. For example, using the situation described above, where the maximum torque is 175 Nm, controller 42 may send a control signal to flow-control assembly causing a limitation of the pump flow such that at any particular discharge pressure, an associated pump flow will not cause a torque greater than 175 Nm on power source 12.

One of ordinary skill in the art will recognize that numerous other characteristics of a control signal may be utilized based on the monitored parameters. For example, controller 42 may determine that, based on a particular operating condition, a control signal should possess characteristics of 12 volts and 1.0 amps.

While controller 42 is depicted separately from ECM 70 in the figures of the present disclosure, it is contemplated that controller 42 may be integrated with ECM 70 such that a single unit—ECM 70—may perform the functions of controller 42.

INDUSTRIAL APPLICABILITY

The disclosed systems and methods may be applicable to any powered system that includes a hydraulic pump. The disclosed systems and methods may allow for control of power distribution from a power source to a hydraulic pump or other power drawing device. In particular, the disclosed systems and methods may assist in aiding machine and/or implement response, emissions control, and limiting power source lugging and/or stalling. Operation of the disclosed systems and methods will now be explained.

A power source may be configured to provide a maximum torque output at a particular power source speed (i.e., torque limited). For example, a power source may have a maximum torque output of 500 Nm at a power source speed of 1500 RPM. Applying a torque greater than 500 Nm to the power source operating at 1500 RPM may cause the power source to cease operation (i.e., stall), among other things. Various speeds of the power source may have related maximum torque outputs and such data may be acquired experimentally. The torque limit for any particular power source speed may also be associated with a fuel volume delivered to the power source at a particular power source load (i.e., applied torque). Therefore, available torque from power source 12 may be predicted based on predetermined fuel volumes to be delivered. The delivered fuel volume to an individual cylinder of the power source may be measured based on fuel pump volume, power source/fuel pump speed, rack position, and the number of cylinders associated with the power source. Alternatively, experimental data may be used to determine delivered fuel volume based on fuel rail pressure and injector open duration. A fuel rail may include a fuel line connecting injectors in a multipoint (e.g., multi-cylinder) fuel injected system. The fuel injector may include a device fluidly connected to the fuel rail, including a fixed or variable orifice designed to open and close, thereby metering and atomizing fuel from the fuel rail into a combustion chamber. ECM 70 may store data indicating delivered fuel volume at numerous rail pressures and fuel injector open durations. For example, such data may indicate that at 1500 bar, with an injector open for a duration of 0.2 seconds, 125 $mm^3$ of fuel may be injected into the related combustion chamber. Therefore, ECM 70 may monitor fuel rail pressure and control injection open duration to deliver a desired fuel volume to a cylinder associated with power source 12. Further, ECM 70 may be communicatively connected to controller 42 such that fuel delivery information may be provided to controller 42. Other suitable configurations for determining delivered fuel volume may also be utilized without departing from the scope of this disclosure.

Operation of a combustion chamber may be dependant on the ratio of air to fuel-vapor that is supplied during operation. When determining the air to fuel-vapor ratio, primary fuel as well as other combustible materials in the combustion chamber (e.g., propane, etc.) may be included as fuel-vapor. The air to fuel-vapor ratio is often expressed as a lambda value, which is derived from the stoichiometric air to fuel-vapor ratio. The stoichiometric air to fuel-vapor ratio is the chemically correct ratio for combustion to take place. A stoichiometric air to fuel-vapor ratio may be considered to be equivalent to a lambda value of 1.0.

Combustion chambers may operate at non-stoichiometric air to fuel-vapor ratios. A combustion chamber with a lower air to fuel-vapor ratio has a lambda less than 1.0 and is said to be rich. A combustion chamber with a higher air to fuel-vapor ratio has a lambda greater than 1.0 and is said to be lean.

Emissions regulations have imposed an additional standard by providing that no power source shall be provided fuel to the point of producing black smoke emissions. Black smoke (e.g., soot) may be produced when lambda becomes less than 1.0 (i.e., fuel in excess of the stoichiometric ratio). Such a condition may occur particularly at low operating speeds of the power source upon a sudden demand for power, for example, an accelerator depressed quickly from minimum to maximum position or full command to an implement. Airflow to the power source may be limited due to low turbocharger velocities, among other things, and the increased fuel may, therefore, cause lambda to drop below 1.0. Therefore, it may be particularly important, especially where power source speeds may be transient (e.g., vehicles accelerating/decelerating while also operating a hydraulic pump), to allow a power source to increase operating speed and therefore obtain increased air flow. This may be accomplished, in part, by limiting the torque load applied to the power source.

Because any power source may be torque limited and because emission standards have created an additional smoke fuel limitation, methods for controlling power distribution associated with a power source may be beneficial.

Figure 3:
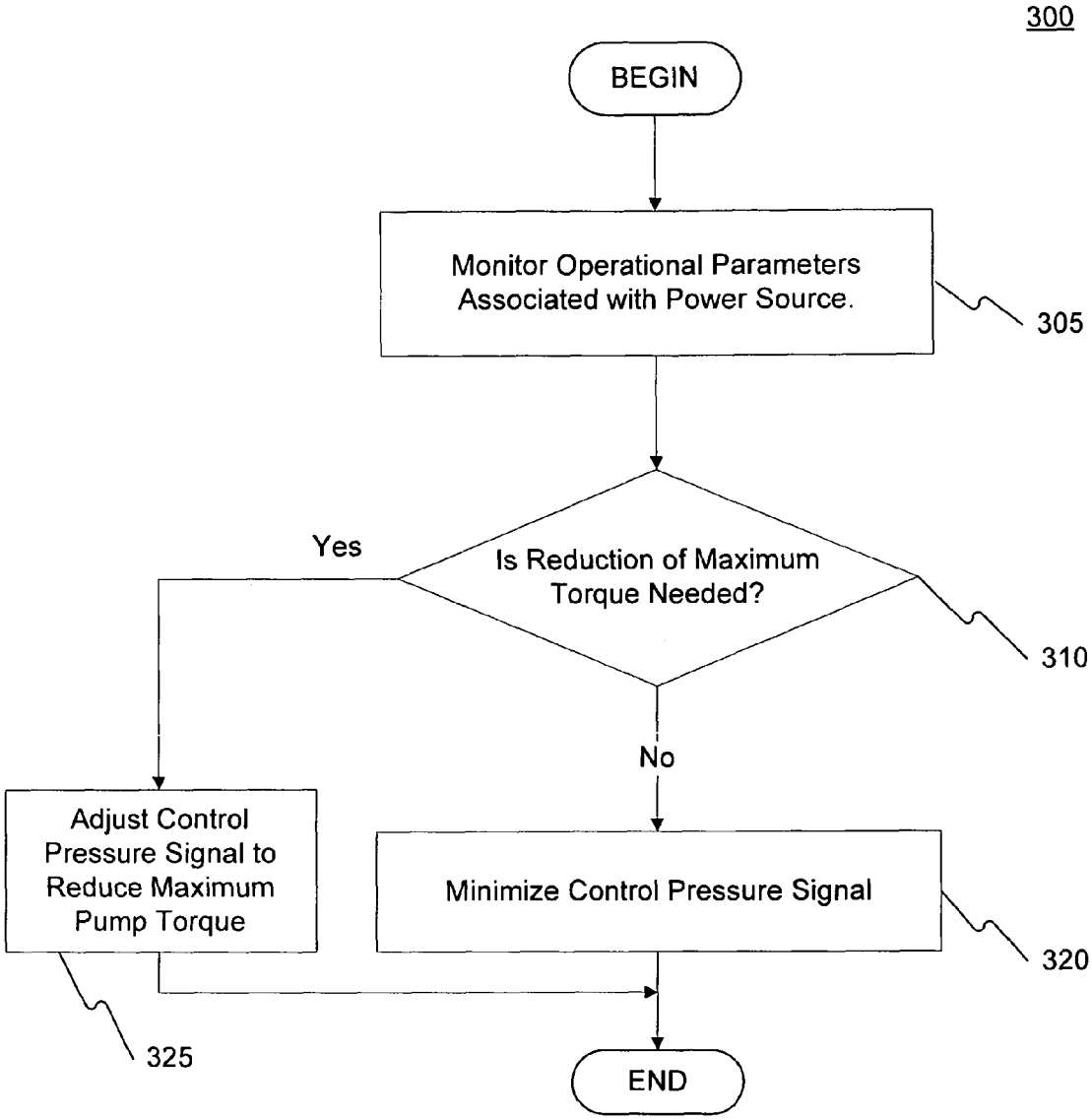
FIG. 3 is an exemplary flowchart illustrating one method for operating systems of the present disclosure.

FIG. 3 is an exemplary flowchart illustrating one method for controlling a torque load applied to a power source by a variable displacement hydraulic pump. Controller 42 may monitor and/or determine at least one parameter associated with operation of power source 12 (step 305). Such parameters may include delivered fuel volumes, fuel limit proximities, power source speed, and an atmospheric pressure, among other things. For example, power source 12 may be idling at 850 RPM under minimal load at sea level with a delivered fuel volume of 25 $mm^3$ per injector stroke. Controller 42 may further include data and/or algorithms related to determining the fuel limit proximities at various engine operating conditions. For example, data may indicate a smoke limit fuel volume of power source 12 at 850 RPM as 85 $mm^3$ of fuel per injector stroke. Using this information, controller 42 may determine the current smoke fuel limit proximity to be 85 $mm^3$ minus the currently supplied 25 $mm^3$ volume, or 60 $mm^3$ per injector stroke (step 310). The determined fuel limit proximity may then be compared to a predetermined value which may indicate a minimum desired fuel limit proximity for power source 12 before adjusting the maximum torque load available to variable displacement hydraulic pump 38. In one embodiment, the predetermined fuel limit proximity value may be 15 $mm^3$ per injector stroke. In the current example, the smoke fuel limit proximity as calculated is 60 $mm^3$ per injector stroke and therefore no reduction of maximum torque is required based on the smoke fuel limit proximity (step 310: no). Controller 42 may continue to generate a signal causing minimal or no adjustment to the maximum flow of pump 38 (step 320). However, as additional load is applied to power source 12 (e.g., implement operation) and as a machine is accelerated (e.g., operator actuating accelerator) additional fuel may be supplied to power source 12. This may narrow the fuel limit proximity absent an increase in power source speed and corresponding increase in airflow. Further, power source 12 may be limited or prevented from increasing speed if under too great a torque load based on implement operation or other load factors. Using fuel limit proximities may allow controller 42 to determine when power source 12 may be attempting to reach a higher operational speed (e.g., accelerate) but may be prevented from reaching such a speed because a load applied to power source 12 may be too great. For example, where the fuel limit proximity decreases to 15 $mm^3$ per injector stroke or less (step 310: yes), controller 42 may determine that more fuel is being provided to power source 12, but the power source 12 is unable to increase its operational speed. Therefore, controller 42 may cause a decrease in at least one load applied to power source 12 (step 325). In one example, a characteristic (e.g., current) of a control signal may be modified and the signal sent to flow-control assembly 52 such that flow from variable displacement hydraulic pump 38 may be reduced by limiting the displacement of hydraulic pump 38. Such a reduction may be based on the actual current command commanded by an operator of machine 10. In other words, where an operator commands 100 percent to an implement, controller 42 may cause that command to be reduced to some fraction of 100 percent (e.g., 30 percent). This may in turn reduce the maximum torque load that variable displacement hydraulic pump 38 may apply to power source 12, thereby allowing power source 12 to increase power source speed. As a power source speed associated with power source 12 increases, air flow to power source 12 may also increase, thereby increasing lambda and fuel limit proximity. Once controller 42 determines that power source is no longer constrained by a fuel limit proximity or other factors, controller 42 may once again allow all loads to be applied modify a characteristic of the control signal such that flow control assembly 52 allows pump 38 to return to its maximum flow (e.g., reducing an electric current to solenoid valve 46) (step 320).

One of skill in the art will recognize that other parameters may be useful in determining a value of a characteristic associated with the control signal. In one embodiment, an anti-stall algorithm may provide stall protection at lower power source speeds by limiting the maximum torque of variable displacement hydraulic pump 38 based on power source speed alone. While power source 12 may be operating at lower than an optimum speed, power source 12 may have a reduced torque availability. Therefore, during periods of low engine speed, controller 42 may sense low engine speed and modify a characteristic of a control signal accordingly. For example, the speed of power source 12 may decrease from 800 RPM to 700 RPM as a result of a decrease in acceleration, an increase in load, etc. As the speed decreases, controller 42 may increase the current associated with a control signal sent to flow control assembly 52. This increase in current may cause an increase in $P_{control}$ resulting in a limitation of flow from variable displacement hydraulic pump 38 and a corresponding decrease in maximum torque that may be applied to power 12 by variable displacement hydraulic pump 38.

In another embodiment, controller 42 may adjust a control signal based on an atmospheric pressure. For example, where the atmospheric pressure surrounding machine 10 is lower than a predetermined value (e.g., 80 KPa), controller 42 may generate a control signal causing a reduction in maximum torque that pump 38 may apply.

By utilizing data such as predetermined fuel delivery volumes and fuel limit proximities for numerous operating conditions of a power source, power distribution associated with power sources having a more transient nature (e.g., heavily accelerated and decelerated machines) may be more precisely controlled. Further, because the method and system of the present disclosure consider resulting emissions (e.g., smoke) when determining how a torque associated with a variable displacement hydraulic pump should be modified, recently enacted emissions regulations may be better adhered to.

While the present disclosure was discussed primarily in the context of limiting a load (e.g., torque) by reducing an implement pump flow temporarily, one of skill in the art will recognize that other methods for limiting a load applied to a power source may be utilized. For example, similar load reductions may be accomplished by reducing a load sense signal such that $P_{dc}$ fed to hydraulic pump 38 may decrease (e.g., by "bleeding off" some pressure). This, in turn may effect a reduction of flow from pump 38. Further, an opening associated with a directional spool valve directing flow of fluid to an implement may be scaled (e.g., reduced) to limit the flow from hydraulic pump 38 (e.g., operator commands 100 percent, valve only opens 30 percent). In yet another example, load reduction may be accomplished by reducing the power draw from a drive train used for propulsion when controller 42 determines that a load reduction may be necessary based on a fuel limit proximity. Numerous other methods of effecting a load reduction may be utilized without departing from the scope of the present disclosure.

It will be apparent to those skilled in the art that various modifications and variations can be made in the method and system for controlling a variable torque pump without departing from the scope of the disclosure. Additionally, other embodiments of the method and system for controlling a variable torque pump will be apparent to those skilled in the art from consideration of the specification. It is intended that the specification and examples be considered as exemplary only, with a true scope of the disclosure being indicated by the following claims and their equivalents.

We claim:

1. A system for controlling power distribution, the system comprising:
- a variable displacement hydraulic pump;
- a power source operatively connected to drive the variable displacement hydraulic pump;
- a flow control assembly configured to control an output of the variable displacement hydraulic pump; and
- a controller configured to monitor a proximity of a power source parameter to a fuel limit of the power source and regulate operation of the flow control assembly based on the proximity.

2. The system of claim 1, wherein the proximity is calculated based on a smoke limit fuel volume and a supplied fuel volume.

3. The system of claim 2, wherein the flow control assembly is regulated to cause a flow reduction of the variable displacement hydraulic pump as the supplied fuel volume approaches the smoke limit fuel volume.

4. The system of claim 2, wherein the proximity is equal to the smoke limit fuel volume minus the supplied fuel volume.

5. The system of claim 1, wherein the proximity is calculated based on a torque limit fuel volume and a supplied fuel volume.

6. The system of claim 5, wherein the flow control assembly is regulated to cause a flow reduction of the variable displacement hydraulic pump as the supplied fuel volume approaches the torque limit fuel volume.

7. The system of claim 1, wherein the output of the variable displacement hydraulic pump is directed to an implement or a steering mechanism, and the controller is further configured to regulate operation of the flow control assembly based also on a load of the implement or steering mechanism.

8. The system of claim 7, wherein the controller is configured to regulate operation of the flow control assembly to reduce the output of the variable displacement hydraulic pump based on the proximity only when the proximity is less than a threshold amount.

9. A system for controlling power distribution of an engine, the system comprising:
- a hydraulic actuator;
- a variable displacement pump driven by the engine to generate a flow of pressurized fluid directed to move the hydraulic actuator;
- a flow control assembly configured to control an output of the variable displacement pump; and
- a controller in communication with the flow control assembly and configured to:
  - monitor a load signal associated with the hydraulic actuator and regulate the flow control assembly to adjust an output of the variable displacement hydraulic pump based on the load signal; and
  - monitor a proximity of an engine parameter to a fuel limit and regulate the flow control assembly to modify the output adjustment of the variable displacement hydraulic pump based on the proximity.

10. The system of claim 9, wherein the hydraulic actuator is associated with a steering mechanism or an implement.

11. The system of claim 9, wherein the proximity is a difference between a smoke limit fuel volume and a supplied fuel limit volume.

12. The system of claim 11, wherein, as the proximity approaches zero, the flow control assembly is regulated by the controller to reduce the output of the variable displacement pump.

13. The system of claim 9, wherein the controller is configured to regulate operation of the flow control assembly to modify the output adjustment only when the proximity is less than a threshold amount.

14. The system of claim 13, wherein the controller is configured to regulate operation of the flow control assembly to modify the output adjustment before the output adjustment is implemented.

15. A system for controlling power distribution of an engine, the system comprising:
- an implement;
- a implement actuator configured to move the implement;
- a variable displacement pump driven by the engine to generate a flow of pressurized fluid directed to the implement actuator; and
- a controller configured to:
  - monitor a load of the implement actuator and determine a corresponding flow adjustment of the variable displacement pump based on the load;
  - monitor a proximity of an engine parameter to a fuel limit that will result from implementation of the flow adjustment;
  - determine a modification of the flow adjustment based on the proximity; and
  - implement the modification when the proximity corresponding to the flow adjustment will be less than a threshold amount.

16. The system of claim 15, wherein the proximity is a difference between a smoke limit fuel volume and a supplied fuel limit volume.

17. The system of claim 15, wherein the controller reduces the output of the variable displacement pump as the proximity approaches zero.

* * * * *